US010889400B2

(12) United States Patent
Gibert Guasch et al.

(10) Patent No.: US 10,889,400 B2
(45) Date of Patent: Jan. 12, 2021

(54) METHOD OF UNWRAPPING A PALLETIZED LOAD AND DEVICE FOR CARRYING OUT SAID METHOD

(71) Applicant: FREIXENET, S.A., Sant Sadurni d'Anoia (ES)

(72) Inventors: Pere Gibert Guasch, Sant Sadurni d Anoia (ES); Marcel Fontcuberta Mas, Argentona (ES); Raul Chavarri Cabezas, Sant Sadurni d Anoia (ES); Jordi Rabada Baiges, Vila-Rodona (ES)

(73) Assignee: FREIXENET, S.A., Sant Sadurni d'Anoia (ES)

( * ) Notice: Subject to any disclaimer, the term of this patent is extended or adjusted under 35 U.S.C. 154(b) by 148 days.

(21) Appl. No.: 16/071,887

(22) PCT Filed: Mar. 2, 2017

(86) PCT No.: PCT/ES2017/070117
§ 371 (c)(1),
(2) Date: Jul. 20, 2018

(87) PCT Pub. No.: WO2017/149187
PCT Pub. Date: Sep. 8, 2017

(65) Prior Publication Data

US 2019/0023442 A1 Jan. 24, 2019

(30) Foreign Application Priority Data

Mar. 3, 2016 (EP) ..... 16382097

(51) Int. Cl.
*B65B 69/00* (2006.01)

(52) U.S. Cl.
CPC ..... *B65B 69/0033* (2013.01)

(58) Field of Classification Search
CPC ..... B65B 69/0033; B65B 69/0041; B65B 69/0025; B65B 69/00; B65B 61/007; B65B 61/12; B65B 21/245
(Continued)

(56) References Cited

U.S. PATENT DOCUMENTS 3,052,397 A * 9/1962 Budd ..... B65D 19/20 206/599
3,889,442 A * 6/1975 Grahn ..... B65B 43/38 53/492
(Continued)

FOREIGN PATENT DOCUMENTS

DE 4311421 A1 10/1994
DE 9314339 U1 2/1995
(Continued)

OTHER PUBLICATIONS

International Search Report and Written Opinion for Application No. PCT/ES2017/070117, dated May 3, 2017 in 15 pages.

*Primary Examiner* — Dariush Seif
(74) *Attorney, Agent, or Firm* — Knobbe, Martens, Olson & Bear, LLP

(57) ABSTRACT

Method of unwrapping a generally parallelepiped palletised load, which comprises making vertical and/or horizontal linear cuts in a plastics material which surrounds the palletised load, wherein at least one of the linear cuts has a discontinuous cut portion which comprises a plurality of cuts of determined length and constant pitch, the method comprising a subsequent step of tearing said discontinuous cut portion.

20 Claims, 17 Drawing Sheets

(58) Field of Classification Search
USPC .... 53/492, 381.1, 381.2; 206/600, 597, 386; 83/660, 835
See application file for complete search history.

(56) References Cited

U.S. PATENT DOCUMENTS

| | | | | | |
|---|---|---|---|---|---|
| 4,502,223 | A * | 3/1985 | Brookfield | B44C 7/027 | 30/365 |
| 4,690,281 | A * | 9/1987 | Berthet | B65D 71/0096 | 206/597 |
| 4,919,270 | A * | 4/1990 | Govang | B65D 5/12 | 206/497 |
| 5,190,430 | A * | 3/1993 | Neri | B65B 43/185 | 414/412 |
| 5,425,219 | A * | 6/1995 | Tanaka | B65B 69/0025 | 414/412 |
| 5,463,841 | A * | 11/1995 | Hayakawa | B65B 69/0033 | 53/381.2 |
| 5,727,747 | A | 3/1998 | Hannen et al. | | |
| 5,758,362 | A * | 6/1998 | Focke | B65B 69/0025 | 414/412 |
| 5,771,661 | A * | 6/1998 | Martin | A24B 3/00 | 414/420 |
| 5,938,036 | A * | 8/1999 | Villemure | B65B 11/585 | 206/596 |
| 6,431,363 | B1 * | 8/2002 | Hacker | B65D 5/5038 | 206/486 |
| 6,766,630 | B2 * | 7/2004 | Rutten | B65B 69/0025 | 242/527 |
| 7,174,695 | B2 * | 2/2007 | Porter | B65B 69/0025 | 53/381.2 |
| 8,065,857 | B2 * | 11/2011 | Rivera | B65D 21/0231 | 53/397 |
| 8,567,293 | B2 * | 10/2013 | Freudenberg | B65B 69/0025 | 83/19 |
| 8,602,213 | B2 * | 12/2013 | Lowery | B65D 71/0096 | 206/459.5 |
| 9,079,680 | B2 * | 7/2015 | Vannice | B65B 69/0025 | |
| 2001/0002652 | A1 * | 6/2001 | Polacco | B65D 77/042 | 206/386 |
| 2003/0177740 | A1 * | 9/2003 | Rutten | B65B 69/0025 | 53/492 |
| 2004/0099110 | A1 * | 5/2004 | Cere | B65B 69/0033 | 83/78 |
| 2004/0250670 | A1 * | 12/2004 | Porter | B65B 69/0025 | 83/401 |
| 2005/0019141 | A1 * | 1/2005 | De Baat | B65B 69/0033 | 414/412 |
| 2005/0196266 | A1 * | 9/2005 | Kropp | B65B 69/0025 | 414/797 |
| 2006/0118456 | A1 * | 6/2006 | Macasaet | B65D 19/18 | 206/600 |
| 2007/0044603 | A1 * | 3/2007 | Scholtes | B65B 69/0025 | 83/13 |
| 2007/0162174 | A1 * | 7/2007 | Doke | B25J 9/0093 | 700/117 |
| 2009/0238501 | A1 * | 9/2009 | Minkler | B65D 19/38 | 383/207 |
| 2009/0301031 | A1 * | 12/2009 | Jacobs | B65B 69/0033 | 53/381.2 |
| 2010/0024188 | A1 * | 2/2010 | Vannice | B65B 69/0025 | 29/426.3 |
| 2012/0222536 | A1 * | 9/2012 | Sain | B65B 69/00 | 83/743 |
| 2016/0001922 | A1 * | 1/2016 | Sadykov | B65D 19/38 | 53/414 |

FOREIGN PATENT DOCUMENTS

| | | | |
|---|---|---|---|
| DE | 102006046389 | A1 | 4/2008 |
| EP | 0249562 | * | 6/1987 |
| EP | 0625465 | * | 9/1993 |
| ES | 2141373 | T3 | 3/2000 |
| FR | 2600040 | A1 | 12/1987 |
| WO | WO 96/09211 | * | 3/1996 |
| WO | 2004/007295 | A1 | 1/2004 |

* cited by examiner

METHOD OF UNWRAPPING A PALLETIZED LOAD AND DEVICE FOR CARRYING OUT SAID METHOD

CROSS-REFERENCE TO RELATED APPLICATIONS

This application is the U.S. National Phase under 35. U.S.C. § 371 of International Application PCT/ES2017/070117, filed Mar. 2, 2017, which claims priority to European Patent Application No. 16382097.0, filed Mar. 3, 2016. The disclosures of the above-described applications are hereby incorporated by reference in their entirety.

FIELD OF THE INVENTION

The present invention relates to a method of unwrapping a palletised load, and a device for carrying out said method.

Bottling and packing plants are supplied with palletised loads consisting of various layers of containers surrounded by a heat shrink or resilient wrapper that covers said containers.

BACKGROUND OF THE INVENTION

As is known, palletised loads are usually enclosed in a wrapper of plastics material which covers said loads. In the case of containers for the food industry, the wrapper and the pallet on which the load is supported completely surround the containers to ensure that insects and dirt cannot enter, and to provide the palletised load with stability.

The load is separated from the pallet by a sheet of plastics material which is encased in the wrapper during the heat shrinking of the wrapper, by which the wrapper is closed over the palletised load. It is also possible to separate the wooden pallet from the load using an insert. Said insert, usually made of a plastics material or cardboard, is also used to separate the various layers of containers. In the case where returnable plastics inserts are used in the palletised load, said elements must be kept for future use.

The unwrapping operation is very often carried out manually, despite it being a labour-intensive task that involves movements of the operator which must be supervised and restricted from the point of view of protecting the health of workers due to the presence of ergonomic risks.

The automatic means and methods currently known present a series of problems.

U.S. Pat. No. 5,727,747 discloses a method and a machine for removing a wrapper from a palletised load in which a continuous vertical cut is made in the wrapper and the load is then rotated in order to "unwind" the plastics material by tearing. The main problem with the machine is that, owing to the heat shrinking of the wrapper, the plastics material has wrinkles or folds that change the behaviour of the load during the unwinding process and in different places. Consequently, the load tilts and the process fails and may even cause the bottles of the load to fall. This results in the production line stopping, as the situation cannot be resolved immediately.

Spanish patent ES2141373 discloses a method for removing the wrapping material that covers multiple superimposed palletised loads. The method comprises making two continuous horizontal cuts in the upper portion of two opposite side faces and two continuous vertical cuts in the same faces. The wrapper is then removed as a complete unit from the upper portion. To do this, a horizontal cut must be made which completely surrounds the load on the side faces of the pallet or alternatively a series of cuts on the lower portion. The upward removal of the plastics material complicates the installation, as does the need to make perimeter cuts and/or through the lower portion of the pallet.

FR2600040 discloses a method of unwrapping a palletised load that is not closed at the upper face, which comprises making numerous continuous horizontal perimeter cuts using a rotating tool actuated by a motor which comprises a series of knives arranged at an angle and a radial blade.

A problem associated with making vertical cuts is that the cutting tool touches the containers, especially if there is a need to cut the zone between the plastics sheets, which is introduced inside the load in zones with no packaging.

The problem of tools contacting the containers is particularly relevant in view of consumer food safety aspects, especially for glass containers (such as bottles) and owing to the loss of strength and integrity said containers may suffer due to said contact, most especially when said containers are to receive gas-carbonated liquids, due to the internal pressure the container must withstand once the liquid is introduced and said container is closed. Contact of the cutting tools with the containers may cause damage to the outer walls or mouths or necks of the containers. In the case of glass containers this damage may take the form of microfissures in the container wall which reduce its mechanical strength and act as concentrators of the forces present, resulting in the container breaking. This effect may be particularly relevant in the manufacture of carbonated drinks, for example, and most particularly sparkling wines produced by the traditional method, such as cava, given that the glass container used is subject to external and internal forces throughout the manufacturing process particularly during the storage and ageing of the bottles and when said bottles are stacked, capped and subjected to thermal shock. At the same time, the resistance of the containers to internal pressure must be significant due to the characteristics of the product.

SUMMARY OF THE INVENTION

An object of the present invention is to disclose a method and means for automatically and safely unwrapping palletised loads while minimising the risk of damage to the containers and system breakdowns or stoppages.

Accordingly, the present invention relates to a method of unwrapping a generally parallelepiped palletised load, which comprises making vertical and/or horizontal linear cuts in a plastics material which surrounds the palletised load, characterised in that at least one of the linear cuts has a discontinuous cut portion which comprises a plurality of cuts of determined length and constant pitch, the method comprising a subsequent step of tearing said discontinuous cut portion.

An advantage of the discontinuous cut is that the plastics material of the heat shrink wrapper is kept in one piece and maintains its original form until torn. In addition, the discontinuous cut prevents damage to the containers of the palletised load, avoiding contact of a cutting tool with said containers at all times.

Preferably, said discontinuous cut portion is vertical and is made on a side face of the palletised load.

An advantage of the present invention is that by means of the discontinuous cuts the plastics wrapper is kept in one piece, and is only pre-cut until the moment of unwrapping.

Preferably, a continuous cut is made in the lower portion of the plastics material nearest the pallet which connects the discontinuous cut portion with the lowest point of the plastics material surrounding the palletised load.

Also preferably, at least one cut is made in the upper base of the palletised load which connects with said discontinuous cut portion.

More preferably, the cut portion in the upper base of the palletised load is oblique relative to the side faces.

Even more preferably, the cut portion in the upper base of the palletised load is a discontinuous cut which comprises a plurality of cuts of determined length and constant pitch.

In a particularly preferred embodiment, at least one horizontal cut is made which runs round three contiguous side faces of the palletised load and crosses the discontinuous vertical cut at one point.

More preferably, said linear cut is continuous and horizontal.

Yet more preferably, a second continuous horizontal cut is made which runs round three side faces of the palletised load in such a way that the plastics material surrounding the palletised load is divided into three zones.

Said horizontal cut or cuts may be made with a hot wire tool.

Preferably said plastics material is torn using robotic arms.

The present invention allows the plastics material to be unwrapped and removed in a single piece.

Preferably, the plastics material that surrounds the palletised load is unwrapped by trapping the plastics material by means of robotic arms which secure said plastics material and by the subsequent advance of the palletised load.

Preferably the plastics material that surrounds the palletised load is a shrink film or resilient plastics material.

Preferably during said method a linear translation of the palletised load takes place with no rotation, thus further ensuring the integrity of the load.

The present invention discloses the use of a rotating cutting tool having a plurality of cutting points or blades arranged at the perimeter of a rotating disc in order to produce a discontinuous cut portion, which comprises a plurality of cuts of determined length and constant pitch, in a method of unwrapping a palletised load.

The present invention also discloses a device suitable for carrying out the method according to the present invention which has means of producing a discontinuous linear cut portion which comprises a plurality of cuts of determined length and constant pitch, which device also has means for tearing said discontinuous linear cut portion.

Preferably, said means for producing a discontinuous linear cut portion comprises a rotating disc with a plurality of cutting points or blades.

More preferably the disc rotates freely about a shaft, having a rolling motion, said shaft not being motorised.

Preferably, the tearing means comprise at least one robotic arm equipped with jaws.

More preferably, the device has jaws with pincers for trapping the torn plastics material.

Yet more preferably, the device has means for transporting the load in order to move the palletised load from a first station, which comprises said means for producing a cut, to a station which comprises said tearing means.

Preferably, the transport means comprise guides.

According to another aspect of the present invention, the present invention also discloses a method of unwrapping a generally parallelepiped palletised load wrapped in a heat shrink plastics material which comprises making vertical and horizontal cuts in the heat shrink plastics material that surrounds the palletised load and removing said plastics material in one piece, characterised in that it comprises a horizontal cut, said cut being extended over at least three contiguous side faces of the heat shrink plastics material, and a vertical cut that crosses said horizontal cuts.

This arrangement of cuts allows the plastics material to be removed by a side or by a face in which no cuts, either horizontal or vertical, have been made. This simplifies the devices to be used and the cut can be made with the load moving exclusively in the forward direction of the production line.

Said vertical cut may be continuous or discontinuous. If it is continuous a "gateway" is produced in the plastics material which causes said plastics material partly to fall under the effect of gravity which makes it difficult to hold for subsequent removal of the plastics material. Although this could be done using modern robotic devices, it is nevertheless preferable to avoid the partial falling of the plastics material, which can be achieved if said vertical cut comprises a discontinuous cut zone, as, since as the plastics material is not completely cut, said plastics material does not partly fall.

The present invention also discloses devices provided for carrying out the above-mentioned methods.

BRIEF DESCRIPTION OF THE DRAWINGS

For a better understanding the accompanying drawings show an embodiment of the present invention as an explanatory but not limiting example.

DETAILED DESCRIPTION OF THE PREFERRED EMBODIMENTS

Figure 1:
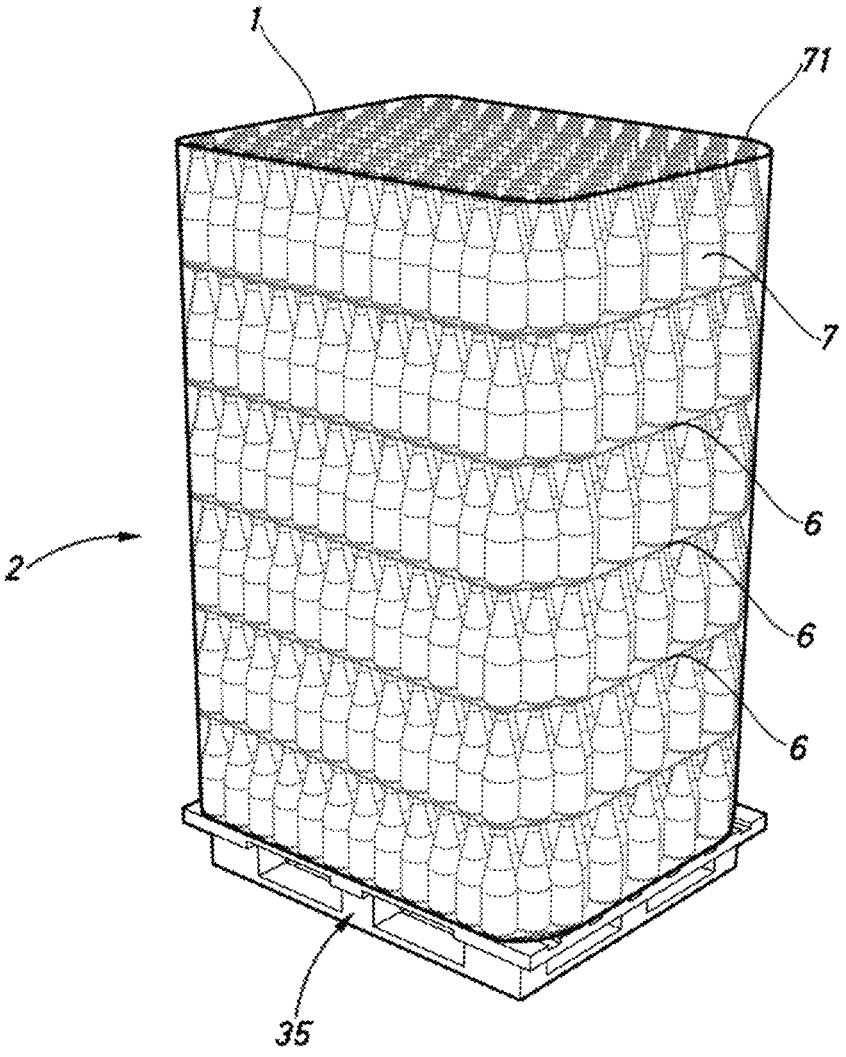
FIG. 1 is a perspective view of the palletised load covered with a wrapper made of a heat shrink or resilient plastics material according to the present invention.

FIG. 1 is a perspective view of the palletised load -2-. The load is covered with a wrapper made of a heat shrink plastics material -1-. The palletised load -2- comprises various layers of bottles -7- which have a bottle neck -71- narrower than the body of said bottle -7-. Said layers are separated by sheets or inserts -6- made of a plastics material or cardboard. If the sheets -6- are reusable provision must be made to avoid damaging them. In the example shown, the bottles -7- are arranged upright on the sheets or inserts keeping the axis of rotation of the container perpendicular to the plane of the sheet or insert -6-. At its lower end, the palletised load -2- has a pallet -35- to facilitate transport thereof.

Figure 2:
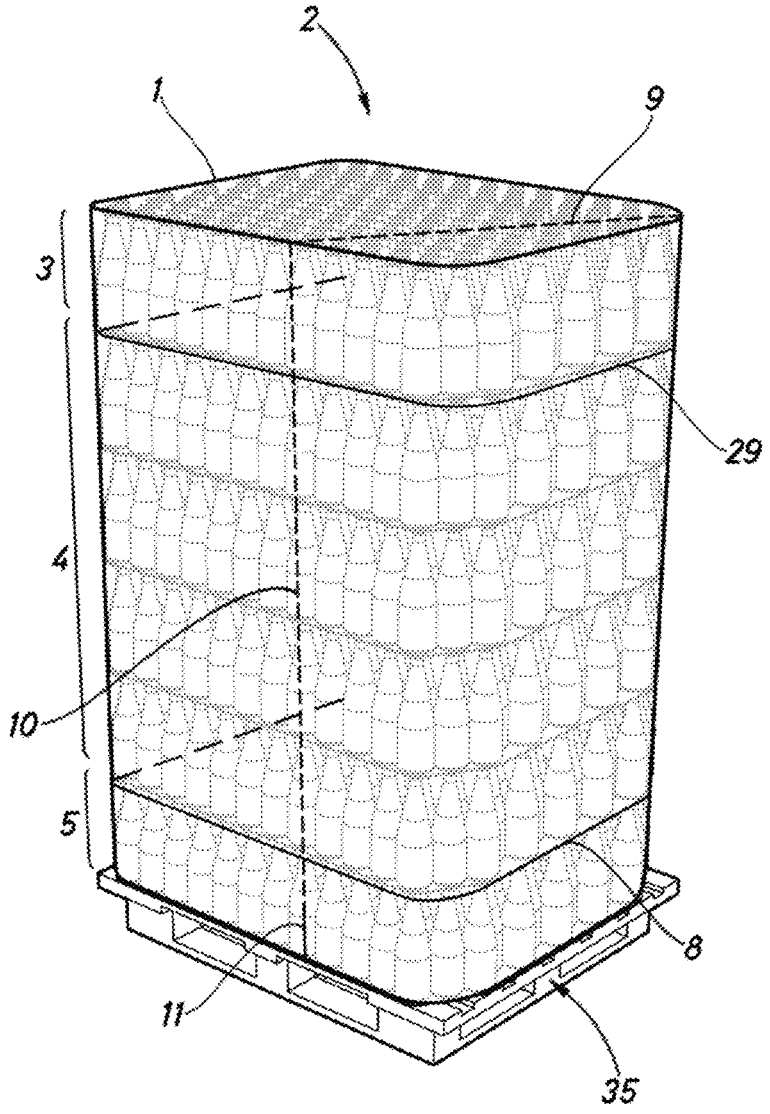
FIG. 2 is a perspective view of the palletised load covered with a wrapper made of a heat shrink or resilient plastics material showing an example of cuts according to the present invention.

FIG. 2 is a perspective view of the palletised load -2- covered by a wrapper made of a heat shrink plastics material -1- showing different cuts to be made in said wrapper according to an embodiment of a cutting process. The palletised load -2- is divided into three zones: an upper plastics material zone -3-, a central plastics material zone -4- and a lower plastics material zone -5-. Said zones correspond to the different portions for unwrapping the wrapper made of a heat shrink or resilient plastics material -1-. A continuous upper horizontal cut -29- and a continuous lower horizontal cut -8- can be seen, just beneath the respective higher and lower sheets or inserts -6-, and also a discontinuous vertical cut -10- and a discontinuous cut -9- on the upper face, in an oblique position relative to the main sides of the wrapped load. Said discontinuous cuts -9- and -10- coincide, that is to say that functionally they form a single discontinuous cut for subsequent tearing. To do this, the cut zones of said cuts must be close enough to each other for the tearing process initiated in one of the cuts to propagate to the other cut.

Finally, a continuous cut -11- can be seen at the lower end of the vertical discontinuous cut -10-. Said discontinuous cut -11- is vertical, configured as a continuation of the discontinuous cut, and is made to ensure the cutting of the wrapper made of a heat shrink plastics material -1- in the lower portion of said wrapper which is thicker to ensure the seal thereof.

The continuous horizontal cuts -29- and -8- have been shown in FIG. 2. On the hidden face, said continuous horizontal cuts -29- and -8- have been shown as a discontinuous line to emphasise that they cannot be seen from the perspective of said figure.

Figure 3:
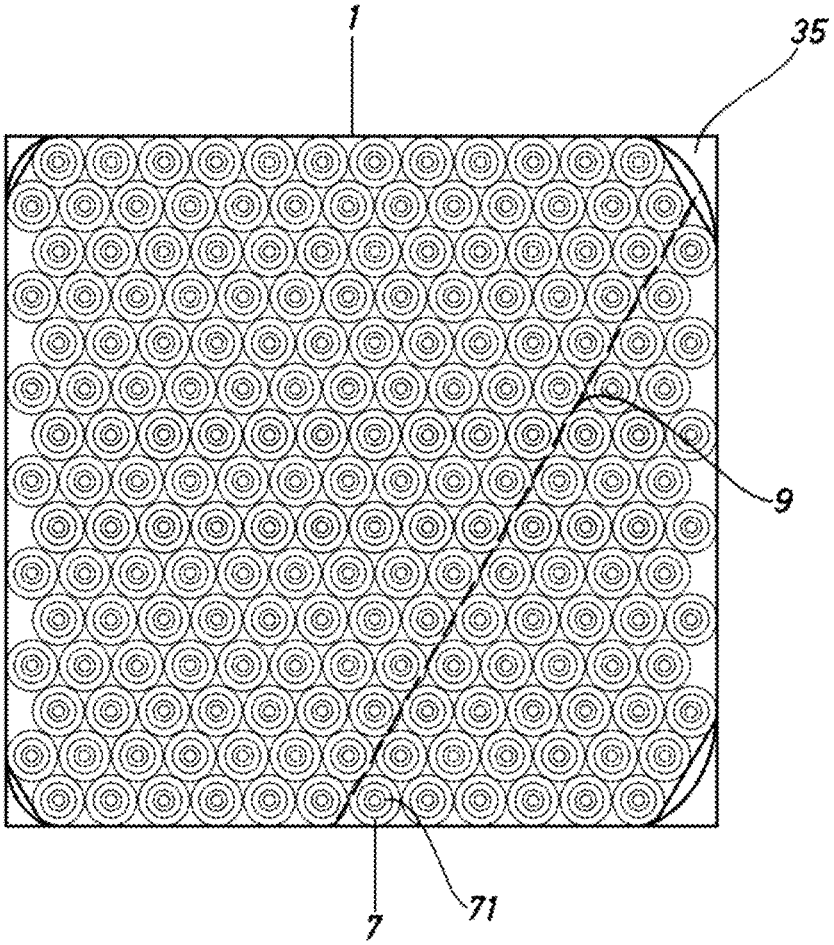
FIG. 3 is a view from above of the palletised load according to the cuts of FIG. 2.

FIG. 3 is a view from above of the palletised load -2- of FIG. 2, formed by a plurality of bottles -7- covered with a wrapper made of a heat shrink plastics material -1-. The oblique cut -9- can be seen on the upper face of said wrapper. Said oblique cut -9- is positioned in such a way that it runs through empty spaces between the necks of the bottles -71- to avoid contact with said bottles. The oblique positioning avoids contact for any type of bottle distribution. For bottles or round containers with a contact angle of 60° (arranged in a quincunx), an orthogonal cut would end up crossing at least a mouth of the container or bottle neck and would therefore be less safe for the containers.

Figure 4:
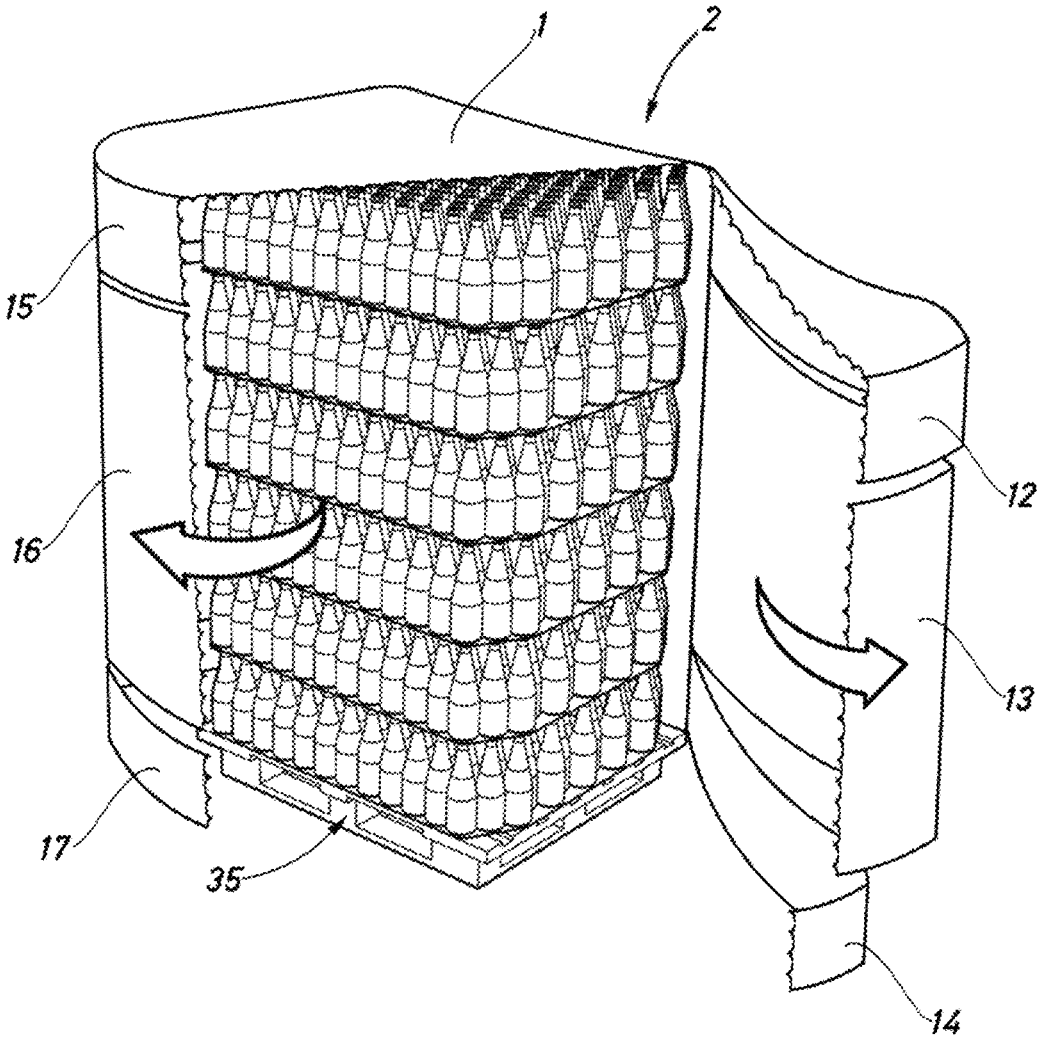
FIG. 4 is a perspective view of the palletised load of FIG. 2 in which the process of removing the wrapper has been shown.

FIG. 4 is a perspective view of the palletised load -2- covered by a wrapper made of a heat shrink plastics material -1- cut according to an example of the method of the present invention. Said plastics wrapper is divided into six portions due to the cuts made according to FIG. 2. However, all the portions are connected at the rear face of the wrapper -1- of the palletised load -2- and the plastics material of the wrapper therefore continues to form a single piece. A left portion of the upper zone of the plastics material -15-, a left portion of the central zone of the plastics material -16-, a left portion of the lower zone of the plastics material -17-, a right portion of the upper zone of the plastics material -12-, a right portion of the central zone of the plastics material -13- and a right portion of the lower zone of the plastics material -14- can be seen.

Figure 5:
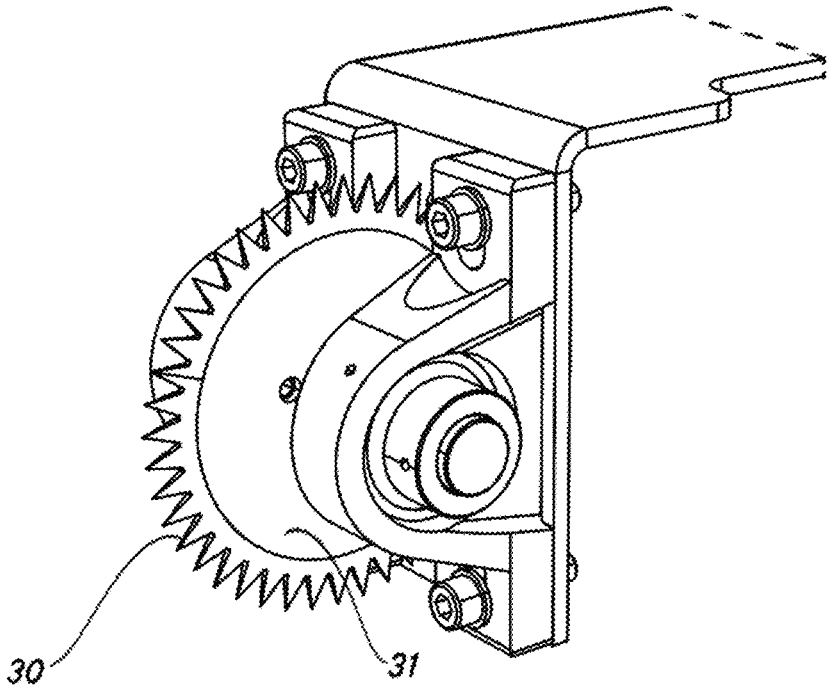
FIG. 5 is a perspective view of the discontinuous cutting tool used in the present invention.

FIG. 5 is a perspective view of a freely rotating cutting disc -31- which comprises various cutting points or blades -30- separated from each other at a constant pitch. Said disc -31- makes discontinuous cuts so as not to sever completely the connection between the different portions of the plastics material that is cut. In the embodiment shown, the disc rotates freely by rolling without sliding; it is not motorised.

Figure 6:
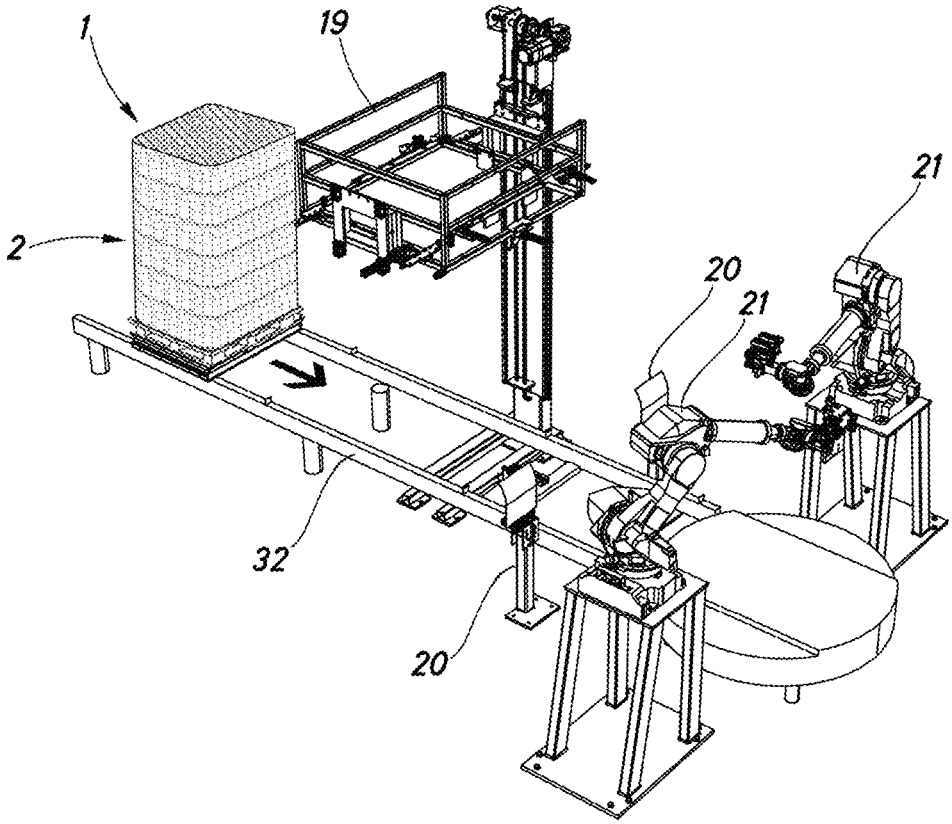
FIG. 6 is a perspective view of an embodiment of a device for unwrapping a palletised load according to the present invention.

FIG. 6 is a perspective view of the unwrapping device with a palletised load -2- at the initial point thereof. The palletised load -2- can be seen covered by the wrapper made of a heat shrink plastics material -1- at the start point of the process. The device comprises transport means, such as guides -32- or a conveyor belt, a cutting mechanism -19-, tools for holding the plastics material -20- and robotic arms -21- on the two sides of the guides -32-. Said guides -32- allow the palletised load -2- to be translated by chains or rollers.

Figure 7:
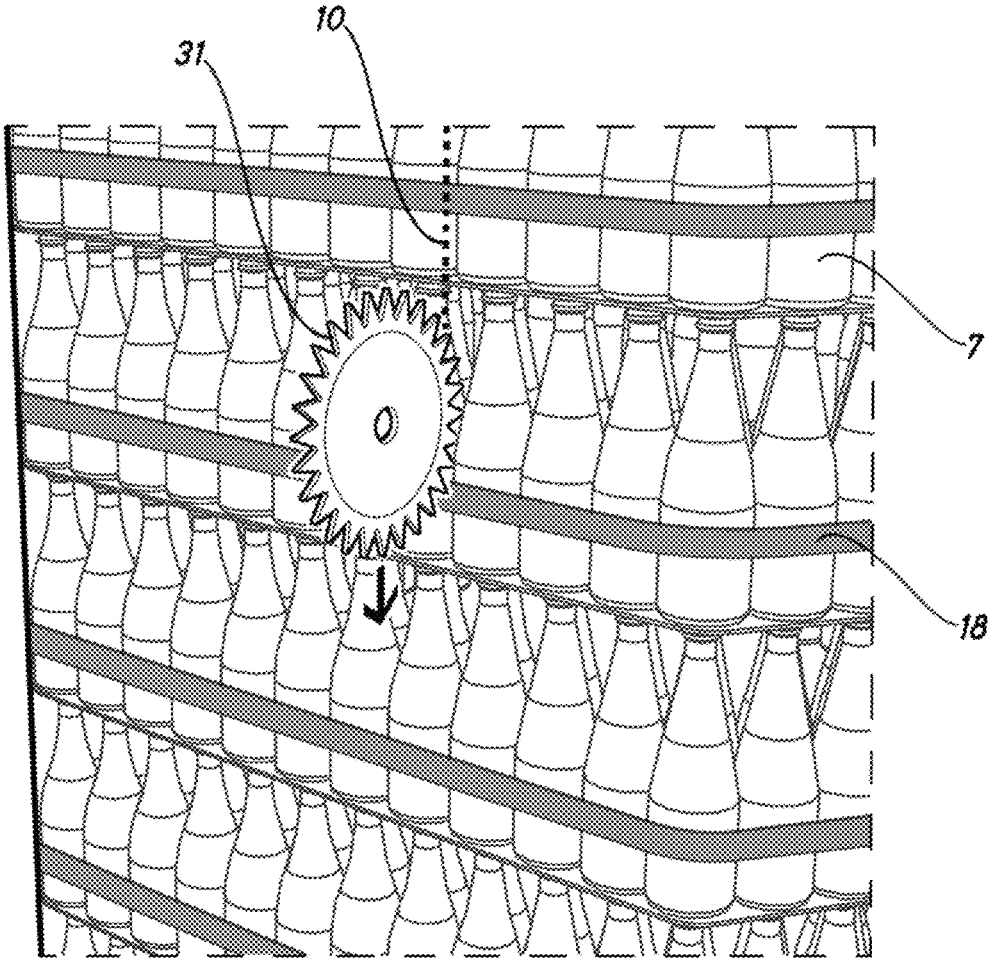
FIG. 7 is a detailed view of the process of making a discontinuous cut in the front face of the pallet.

FIG. 7 is a detailed view of the process of making the discontinuous vertical cut -10- on the front face of the palletised load -2-. It can be seen that said vertical cut -10- is made on the vertical where the bottles -7-, owing to the positioning thereof in a quincunx, are in the position farthest from the plastics wrapper. In this particular embodiment hoops -18- are provided which help position the bottles -7- correctly. Because discontinuous cuts are made using a tool with points, said hoops -18- are not cut by the cutting disc -31-.

Figure 8:
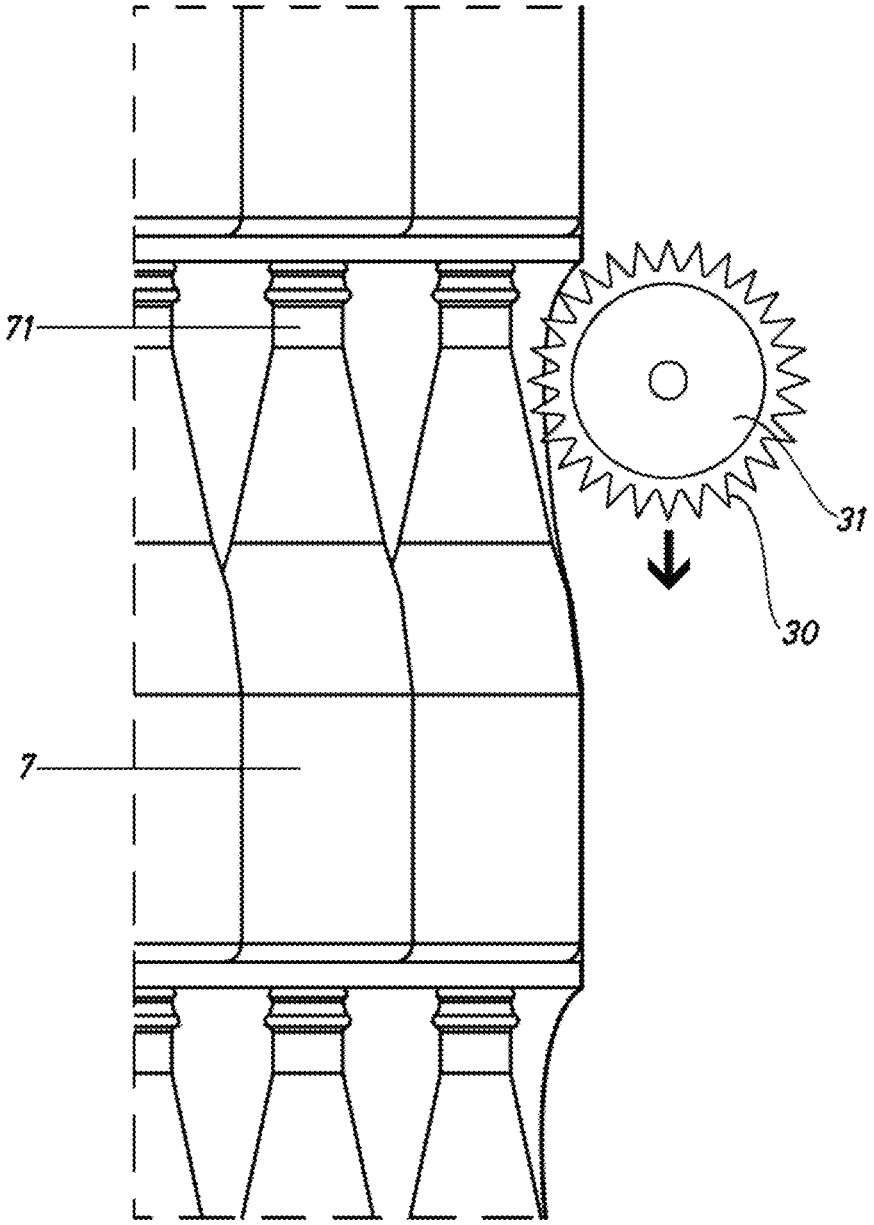
FIG. 8 is a detailed view in elevation of a process of making a discontinuous cut of a palletised load according to the present invention.

FIG. 8 is a view in lateral cross section of the different layers of bottles -7- in the palletised load. The cutting disc -31- having its plurality of points -30- penetrates the wrapper made of a heat shrink plastics material making a discontinuous cut, without at any time touching the bottles -7- or the bottle necks -71-.

Figure 9:
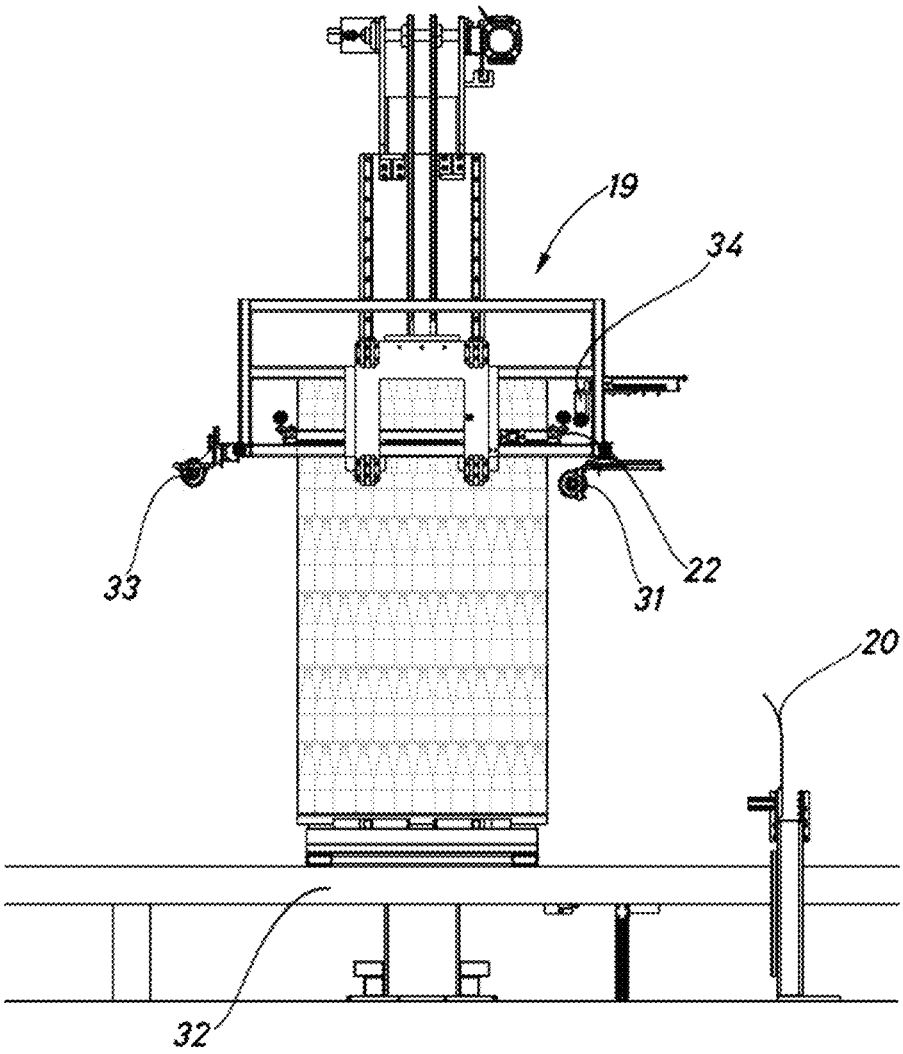
FIG. 9 is a view in elevation of a process of cutting the plastics wrapper of a palletised load according to the present invention using the device of FIG. 6.

FIG. 9 is a view in elevation of the process of cutting a palletised load using the cutting mechanism -19-. Said cutting mechanism -19- has two distinct cutting tools: the cutting disc -31- and a hot wire device -22-. The cutting disc -31- makes discontinuous cuts whereas the hot wire -22- makes continuous cuts.

First with the cutting mechanism -19- in the top position (level with the upper face of the palletised load -2-), the discontinuous cut -9- is made in an oblique direction diagonal to the cutting disc -33- by the advance of the palletised load -2- on the guides -32-. Next, the cutting mechanism -19- moves towards the floor making the vertical discontinuous cut -10- during said travel by means of the cutting disc -31-.

Next the continuous horizontal cuts -29- and -8- are made using the hot wire -22-, and finally the continuous vertical cut -11- is made by means of a hot plate -34-.

Figure 10:
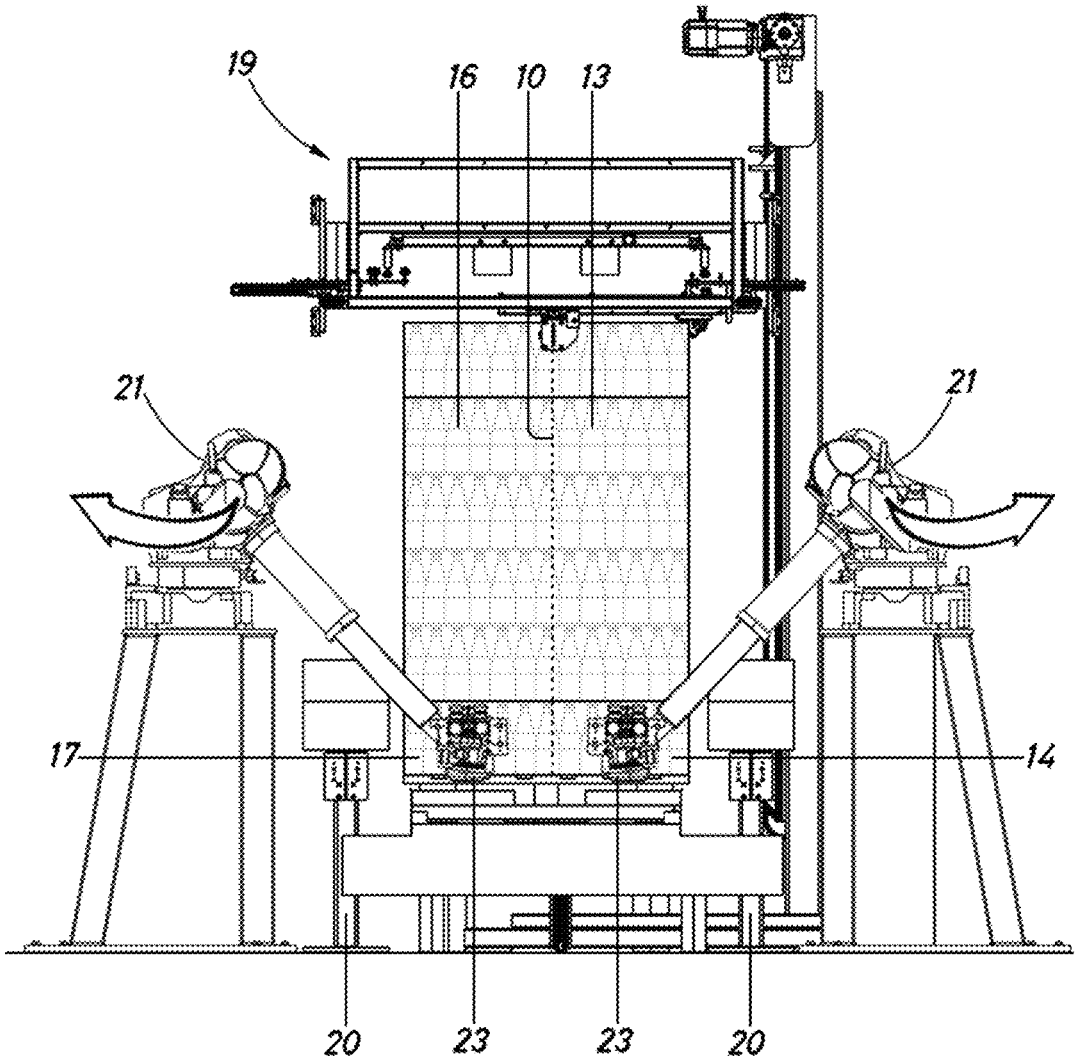
FIG. 10 is a side view of a first stage of the process of tearing the plastics wrapper of a palletised load according to the present invention.

FIG. 10 is a side view of a first stage of the process of tearing the plastics wrapper of a palletised load. At this point of the process the cutting mechanism -19- has already made all the cuts. It can be seen that the jaws -23- of the robotic arms are holding the right and left portions of the lower zone of the plastics material -17- and -14 in order to tear the plastics material along its vertical discontinuous cut -10- and to place said left and right portions -17- and -14- in the respective tools for holding the plastics material -20- by rotating the robotic arms -21-.

Figure 11:
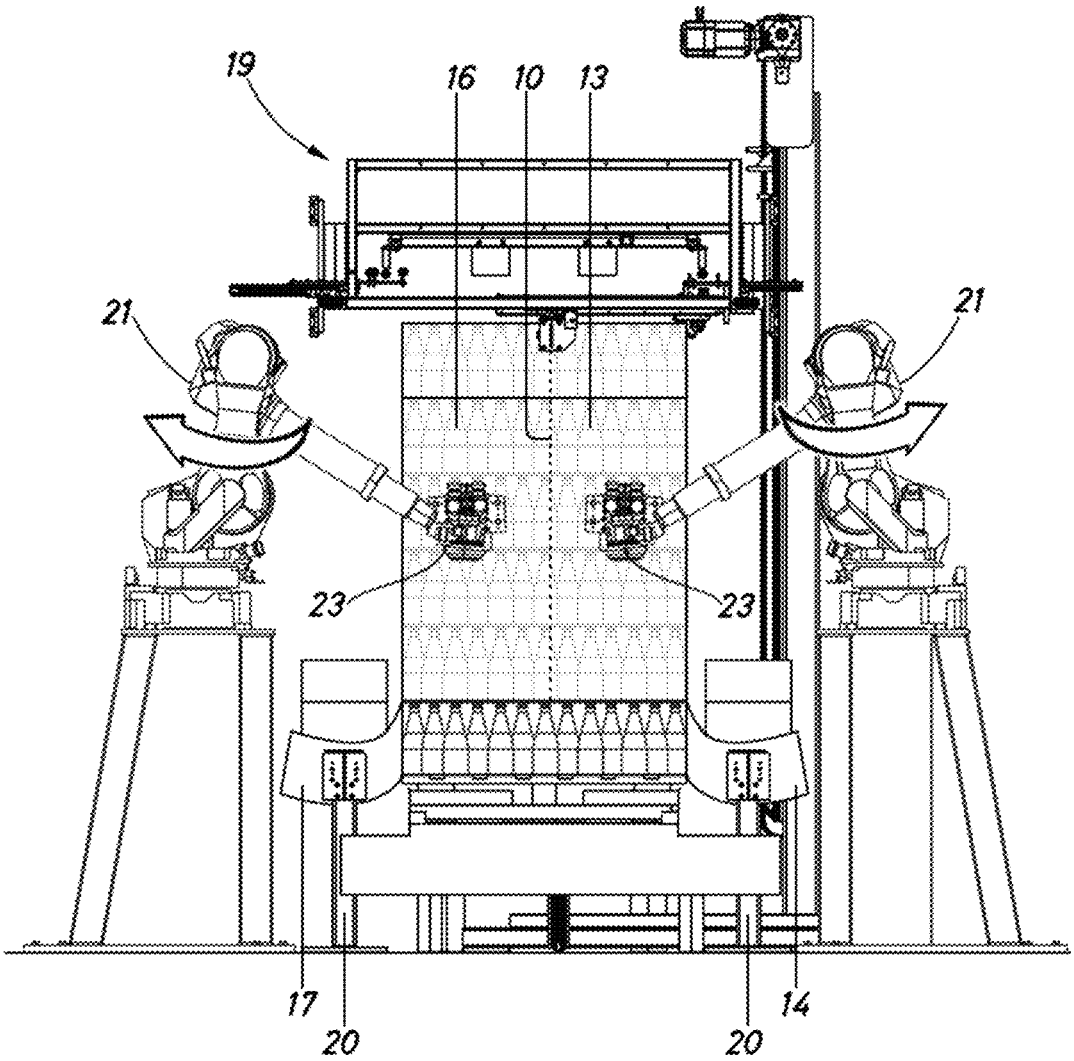
FIG. 11 is a side view of a second stage of the process of tearing the plastics wrapper of a palletised load according to the present invention.

FIG. 11 is a side view of the process of tearing the plastics wrapper of a palletised load in a second stage, which is a continuation of that in FIG. 10. Using their jaws and implements -23-, the robotic arms -21- have previously placed the left and right portions of the lower zone of the plastics material -17- and -14- in the respective tools for holding the plastics material -20-, said portions being physically held. It can be seen that the jaws of the robotic arms -23- are holding the right and left portions of the central zone of the plastics material -13- and -16- in order to tear the plastics material along the discontinuous vertical cut -10- thereof and subsequently to place said plastics material in the respective holding tools of the plastics material -20- by rotating the robotic arms -21-.

Figure 12:
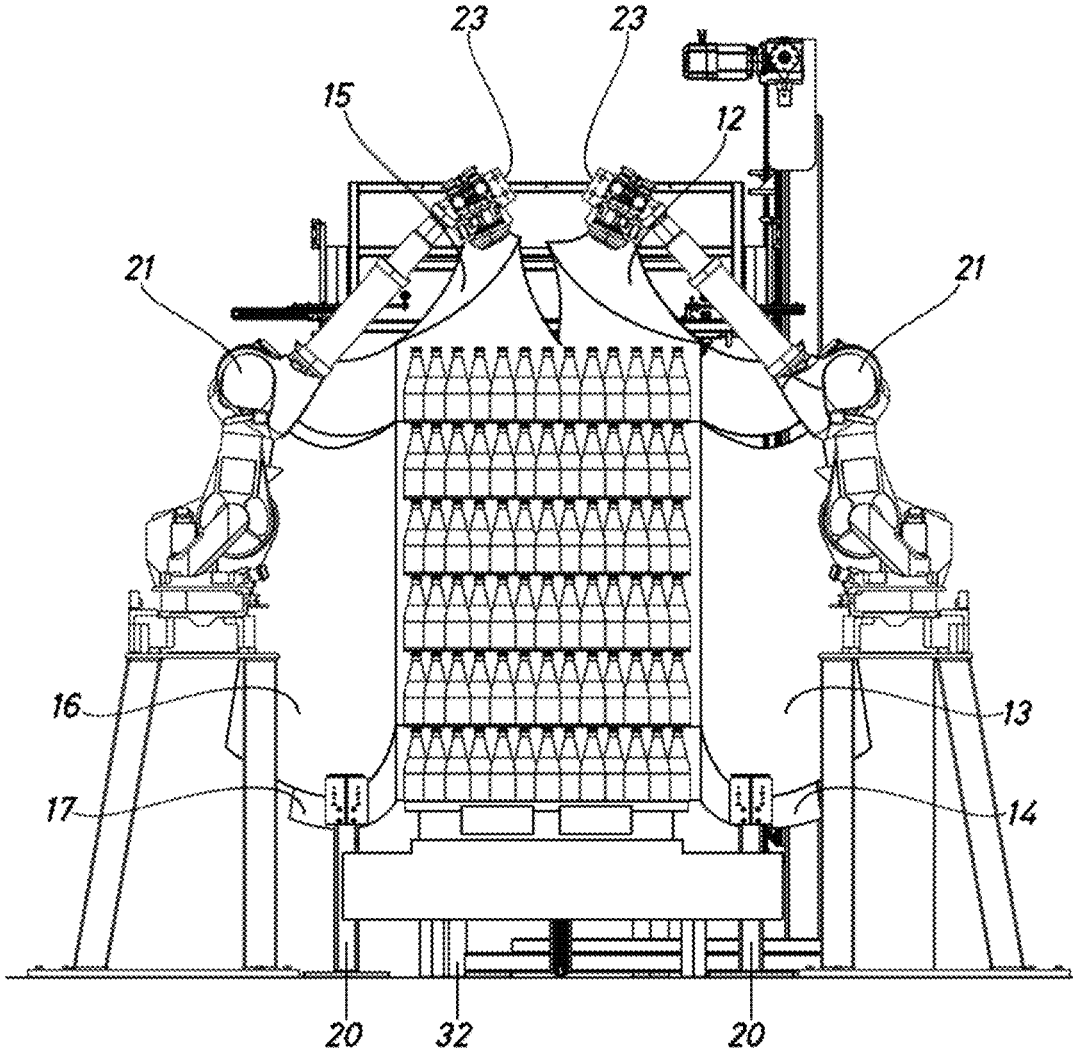
FIG. 12 is a side view of a third stage of the process of tearing the plastics wrapper of a palletised load according to the present invention.

FIG. 12 is a side view of the process of unwrapping the plastics wrapper of a palletised load. The right and left portions of the central zone and the lower zone of the plastics material respectively -16-, -17-, -14- and -13- are held in the respective tools for holding the plastics material -20-. The jaws -23- of the robotic arms hold the right and left portions respectively of the upper zones of the plastics material -15- and -12-. Once in this situation, the palletised load -2- moves forward releasing the plastics wrapper -1- since said wrapper is held secure being held by the above-mentioned different elements.

Figure 13:
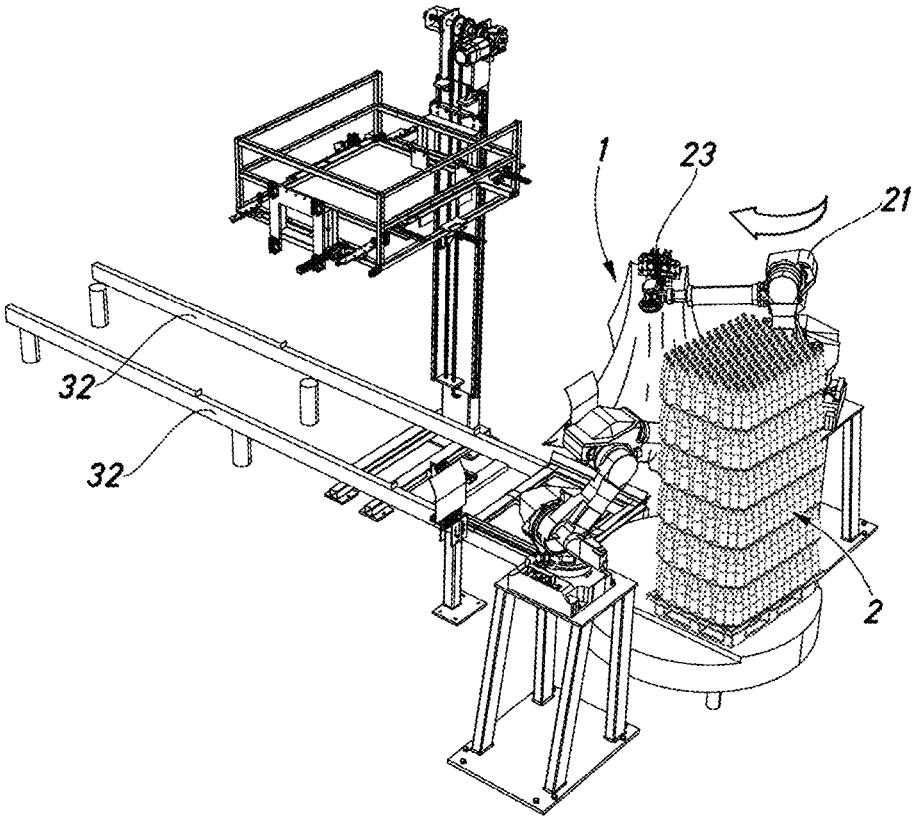
FIG. 13 is a perspective view of the process of removing the plastics wrapper from a palletised load according to the present invention.

FIG. 13 is a perspective view of the process of removing the plastics wrapper -1- of the palletised load -2-, already drawn from the palletised load, by rotating the right robotic arm -21- which holds the plastics wrapper -1- with the jaw -23- of the robotic arm -21-.

Figure 14:
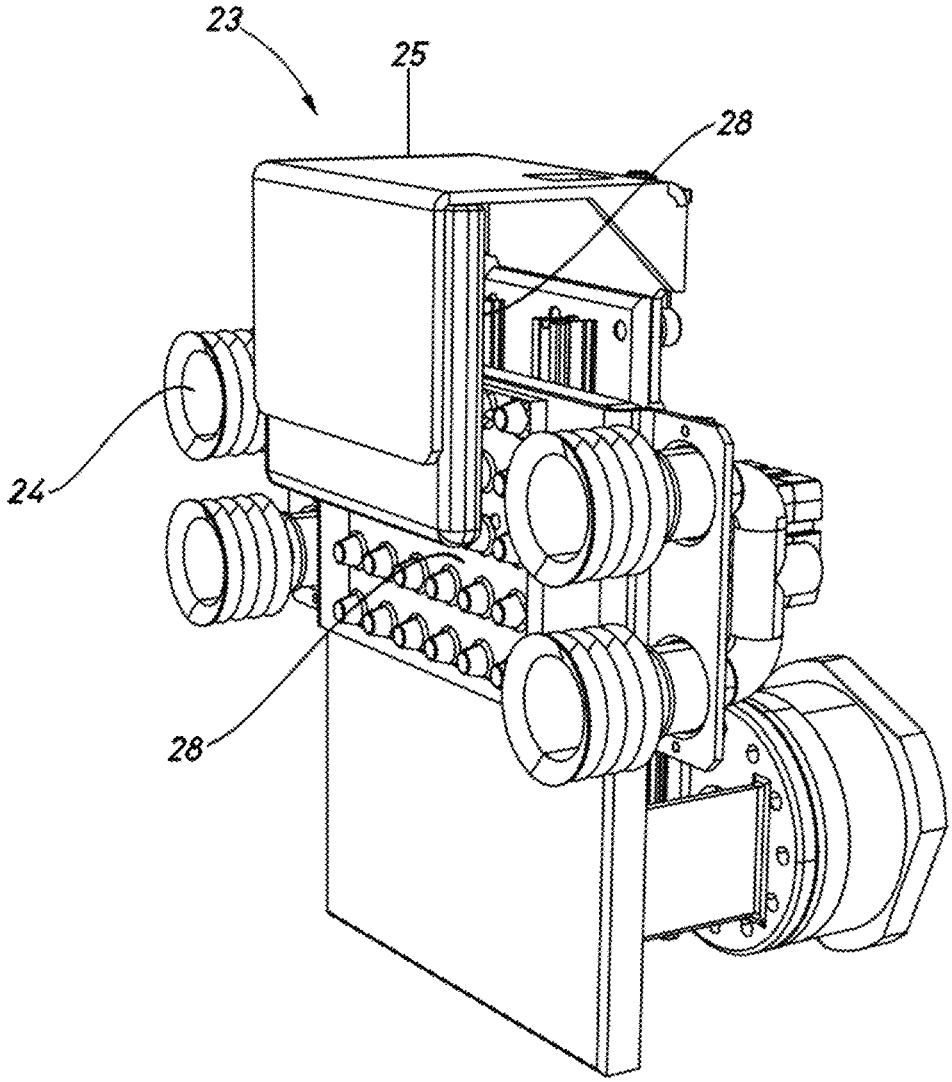
FIG. 14 is a perspective view of a jaw of the robotic arm according to the present invention.

FIG. 14 is a perspective view of the jaw -23- of the robotic arm -21-. Said jaw -23- has various air suckers -24- and a pincer -25- formed by two combined faces -28-. The holding and subsequent tearing of the plastics wrapper is carried out by suction of the plastics material so as to be able to produce a cut by means of the pincer -25- and subsequently said pincer -25- is closed, the plastics material being held between the combined faces -28-.

Figure 15:
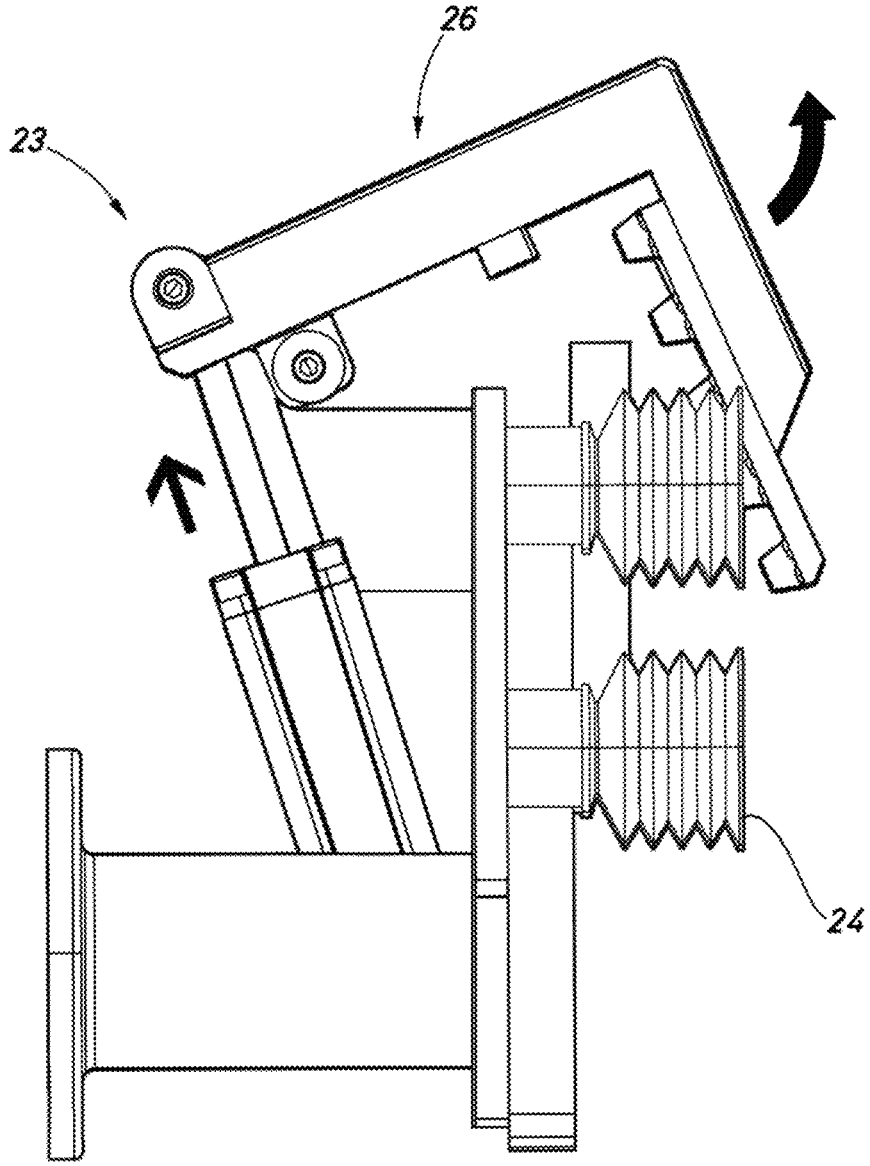
FIG. 15 is a perspective view of a second embodiment of the jaw of the robotic arm according to the present invention.

FIG. 15 is a perspective view of the jaw -23- of the robotic arm -21- in a second embodiment according to the present invention in which said pincer -26- is in a tilted position.

Figure 16:
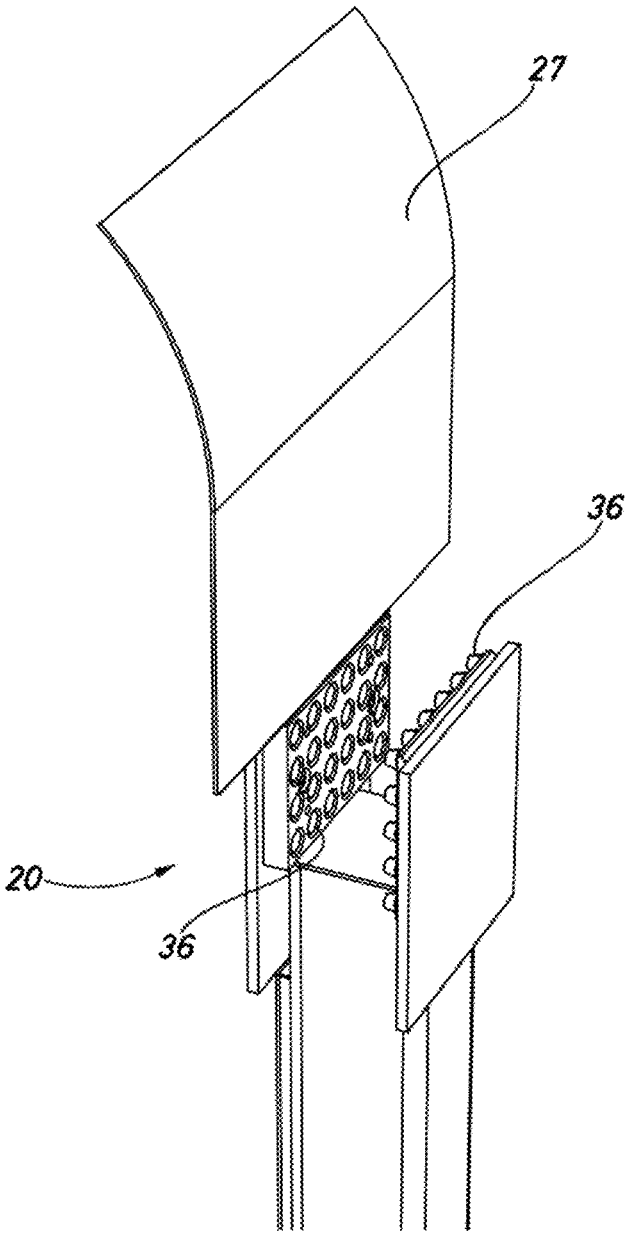
FIG. 16 is a perspective view of the holding tool of the plastics wrapper according to the present invention.

FIG. 16 is a perspective view of the tool -20- for holding the plastics wrapper, said tool -20- has a curved plate -27- which facilitates entry between the combined faces -36-, which can bring together their faces in order to hold the plastics material which is introduced into said tool.

Figure 17:
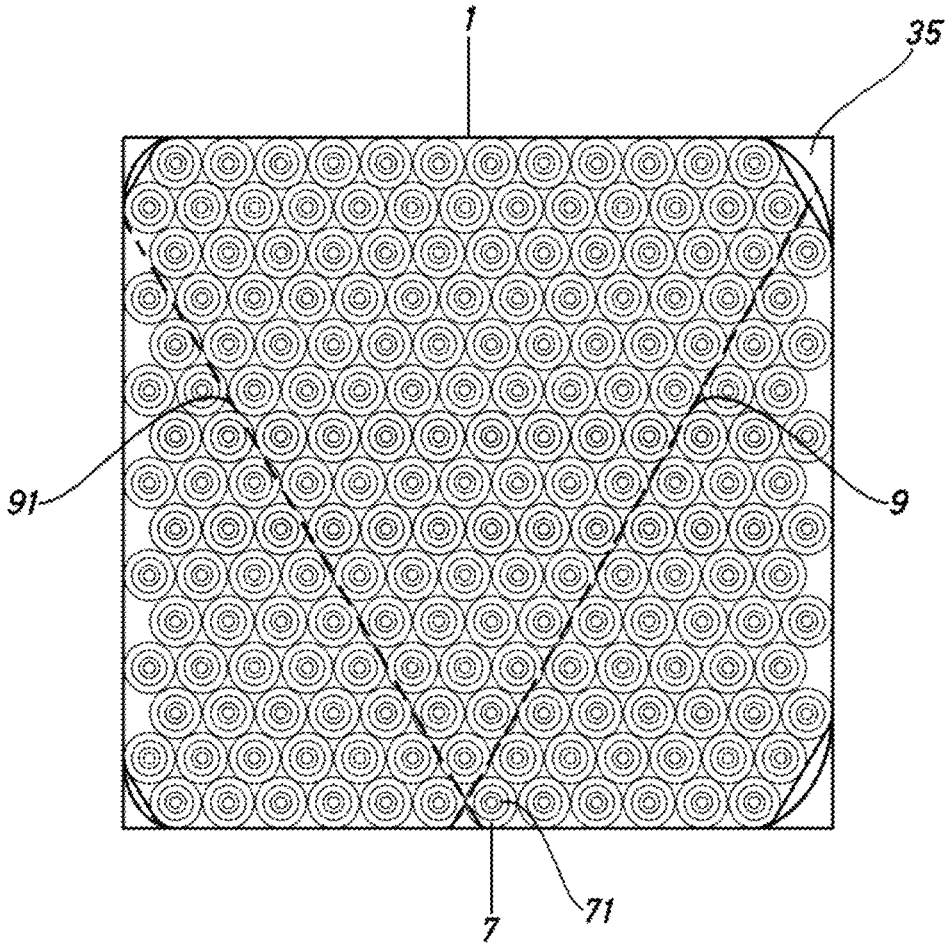
FIG. 17 is a view from above of the palletised load with the cuts according to another embodiment.

FIG. 17 is a plan view of the palletised load -2- of FIG. 2 in another embodiment, formed by a plurality of bottles -7- covered by a wrapper made of a heat shrink plastics material -1-. Two oblique cuts -9- and -91- can be seen on the upper face of said wrapper. Said oblique cuts -9- and -91- form a "V" shaped cut and are arranged in such a way that they run across the empty spaces between the necks of the bottles -71- to avoid contact with said bottles. The oblique arrangement avoids contact for any kind of bottle distribution. Since they are symmetrical, said oblique cuts -9- and -91- facilitate the unwrapping of the wrapper made of a heat shrink plastics material -1- compared with the embodiment of FIG. 3.

In an embodiment that has not been illustrated, the palletised load also has a cardboard lid beneath the plastics wrapper. In this case said cardboard lid can be removed vertically by means of a third additional robotic arm (not shown in the figures) after the cutting and unwrapping process.

Said third additional robotic arm could have an additional function of ensuring the palletised load remains vertical throughout the process in order to avoid movement or tilting thereof which would interfere with the correct operation of the unwrapping device.

Although the invention has been presented and described with reference to embodiments thereof, it will be understood that said embodiments do not limit the invention, which could therefore be varied by many structural or other details which would be clear to persons skilled in the art after interpreting the material disclosed in the present description, claims and drawings. All the variants and equivalents are therefore included within the scope of the present invention if they can be considered to fall within the most extensive scope of the following claims.

What is claimed is:

1. A method of unwrapping a generally parallelepiped palletized load comprising:

providing a palletized load surrounded by a plastics material, making vertical and/or horizontal linear cuts in the plastics material which surrounds the palletized load, wherein at least one of the linear cuts has a discontinuous cut portion which comprises a plurality of cuts of a certain length and constant pitch, and tearing said discontinuous cut portion, trapping the torn edges of the plastics material that surrounds the palletized load by robotic arms to hold said plastics material and subsequently advancing the palletized load to unwrap the palletized load.

2. The method according to claim 1, wherein said discontinuous cut portion is vertical and is made on a side face of the palletized load.

3. The method according to claim 2, wherein a continuous cut is made in a lower portion of the plastics material nearest the pallet which connects the discontinuous cut portion with the lowest point of the plastics material surrounding the palletized load.

4. The method according to claim 2, wherein at least one cut is made in the upper base of the palletized load which connects with said discontinuous cut portion.

5. The method according to claim 4, wherein the cut portion in the upper base of the palletized load is oblique relative to the side faces.

6. The method according to claim 4, wherein the cut portion in the upper base of the palletized load is a discontinuous cut which comprises a plurality of cuts of determined length and constant pitch.

7. The method according to claim 2, wherein at least one horizontal cut is made which runs round three contiguous side faces of the palletized load and crosses the discontinuous vertical cut at one point.

8. The method according to claim 7, wherein said linear cut is continuous and horizontal.

9. The method according to either claim 7, wherein a second continuous horizontal cut is made which runs round three side faces of the palletized load in such a way that the plastics material surrounding the palletized load is divided into three zones.

10. The method according to claim 7, wherein said horizontal cut or cuts may be made with a hot wire tool.

11. The method according to claim 1, wherein said plastics material is torn using the robotic arms.

12. The method according to claim 1, wherein the plastics material is unwrapped and removed in a single piece.

13. The method according to claim 1, wherein the plastics material that surrounds the palletized load is a shrink film or resilient plastics material.

14. The method according to claim 1, wherein during said method a linear translation of the palletized load takes place with no rotation.

15. The method according to claim 1, wherein the discontinuous cut portion are formed by a rotating cutting tool having a plurality of cutting points or blades arranged at the perimeter of a rotating disc.

16. A device for unwrapping a generally parallelepiped palletized load surrounded by a plastics material comprising:

a rotating disc having a plurality of cutting points or blades, wherein the rotating disc is configured to rotate freely about a shaft to have a rolling motion such that the a plurality of cutting points or blades penetrate the plastics material without sliding, so as to produce a discontinuous linear cut portion which comprises a plurality of cuts of determined length and constant pitch, and a pincer configured to tear said discontinuous linear cut portion, wherein the pincer is included in jaws of at least one robotic arm equipped with said jaws, wherein at least one robotic arm is configured to trap the torn edges of the plastics material that surrounds the palletized load to hold said plastics material so as to unwrap the palletized load by subsequent advance of the palletized load.

17. The device according to claim 16, wherein said shaft not being motorized.

18. The device according to claim 16, wherein said pincer is configured to trap torn plastics material.

19. The device according to claim 16, wherein said device comprises a path configured to facilitate movement of the palletized load from a first station, which comprises said rotating disc for producing a cut, to a station which comprises said pincer.

20. The device according to claim 19, wherein path comprises guides.

* * * * *